US008782861B2

(12) United States Patent
Muenstermann

(10) Patent No.: US 8,782,861 B2
(45) Date of Patent: Jul. 22, 2014

(54) APPARATUS FOR COMPACTING A FIBER WEB

(75) Inventor: Ullrich Muenstermann, Egelsbach (DE)

(73) Assignee: Truetzschler Nonwovens GmbH, Egelsbach (DE)

( * ) Notice: Subject to any disclaimer, the term of this patent is extended or adjusted under 35 U.S.C. 154(b) by 146 days.

(21) Appl. No.: 13/263,676

(22) PCT Filed: Mar. 25, 2010

(86) PCT No.: PCT/DE2010/000337

§ 371 (c)(1),
(2), (4) Date: Dec. 28, 2011

(87) PCT Pub. No.: WO2010/115400

PCT Pub. Date: Oct. 14, 2010

(65) Prior Publication Data

US 2012/0096694 A1 Apr. 26, 2012

(30) Foreign Application Priority Data

Apr. 8, 2009 (DE) ..... 10 2009 016 996
Apr. 11, 2009 (DE) ..... 10 2009 017 729

(51) Int. Cl.
*D04H 1/48* (2012.01)
*D04H 1/49* (2012.01)
*D06C 21/00* (2006.01)

(52) U.S. Cl.
CPC ..... *D04H 1/49* (2013.01); *D06C 21/005* (2013.01)
USPC ..... 28/105; 28/122; 28/167; 26/18.6

(58) Field of Classification Search
CPC ..... D04H 1/465; D04H 1/46; D04H 1/49; D04H 1/482; D04H 1/492; D04H 1/44; D04H 18/04; D04H 1/48; D04H 5/03; D06C 21/00; D06C 21/005
USPC ..... 28/104, 105, 167, 116, 122, 19, 20; 26/18.6; 162/348, 358.3, 358.4
See application file for complete search history.

(56) References Cited

U.S. PATENT DOCUMENTS 2,730,933 A 1/1956 Reynolds
4,072,557 A * 2/1978 Schiel ..... 162/111
(Continued)

FOREIGN PATENT DOCUMENTS

DE 10 2005 055 939 B3 2/2007
EP 0 859 076 A2 8/1998
(Continued)

*Primary Examiner* — Amy Vanatta
(74) *Attorney, Agent, or Firm* — Muncy, Geissler, Olds & Lowe, P.C.

(57) ABSTRACT

The invention relates to an apparatus for compacting a material web made of fibers and/or filaments, comprising a first revolving endless belt which carries the material web and is tensioned around guide rollers, and a second endless belt which is tensioned around guide rollers and revolves counter to the first belt at the same speed, wherein the first and second endless belts form a conical compacting region in a first region in the conveying direction of the material web and run at an angle with respect to each other, whereby the material web located between the belts is increasingly pressed, wherein subsequent to the first region a first nozzle beam is disposed for a first fluid application onto the material web still located between the two endless belts, wherein the two belts in this region of the first fluid application are in each case guided to run in a tensioned manner in a straight direction. According to the invention, the following is provided: the two belts (1,2) are guided in the region of the first fluid application (D,W,A) such that they do not run parallel to each other, or: the two belts (1,2) are guided in the region of the first fluid application (D,W,A) such that they run parallel to each other in a first section (AB1) and not parallel to each other in a subsequent second section (AB2).

11 Claims, 11 Drawing Sheets

(56) References Cited

U.S. PATENT DOCUMENTS

| | | | | |
|---|---|---|---|---|
| 5,960,525 | A * | 10/1999 | Fleissner | 28/104 |
| 6,055,710 | A * | 5/2000 | Fleissner | 28/104 |
| 6,058,583 | A * | 5/2000 | Takeuchi et al. | 28/104 |
| 6,412,155 | B2 * | 7/2002 | Fleissner | 28/104 |
| 7,392,575 | B2 * | 7/2008 | Noelle | 28/116 |
| 7,500,294 | B2 * | 3/2009 | Schweizer et al. | 28/167 |
| 7,631,406 | B2 * | 12/2009 | Fechter | 28/104 |
| 2005/0091811 | A1 * | 5/2005 | Billgren et al. | 28/104 |
| 2011/0277284 | A1 * | 11/2011 | Muenstermann | 28/104 |

FOREIGN PATENT DOCUMENTS

| | | | |
|---|---|---|---|
| EP | 0 972 873 | A1 | 1/2000 |
| EP | 1 126 064 | A2 | 8/2001 |
| WO | WO 2004/046444 | A1 | 6/2004 |
| WO | WO 2008/107549 | A2 | 9/2008 |
| WO | WO 2008/110134 | A1 | 9/2008 |

* cited by examiner

APPARATUS FOR COMPACTING A FIBER WEB

This application is a national stage of International Application No.: PCT/DE2010/000337, which was filed on Mar. 25, 2010, and which claims priority to German Patent Application Nos.: DE 10 2009 016 996.2, which was filed in Germany on Apr. 8, 2009; and to DE 10 2009 017 729.9, which was filed in Germany on Apr. 11, 2009, and which are both herein incorporated by reference.

The invention relates to an apparatus for compacting a fiber web according to the precharacterizing part of claim 1.

From EP-A-0-859 076, there is known an apparatus for compacting the fibers of a fiber web of natural and/or synthetic fibers of any type, wherein a belt/drum-type compaction of the fiber web is performed. Said apparatus comprises the following features and respectively is designed as indicated hereunder:

- a first endless belt supporting the fiber web, said belt being guided and trained in a tensioned state between two rollers,
- a permeable needling drum having the endless belt wrapped around it,
- a second endless belt, assigned to said first endless belt and also guided and in a tensioned state between two rollers, wherein the working strand of said second endless belt which is opposite to the working strand of the first endless belt is arranged to revolve in a driven manner in the same direction as that of the first endless belt,
- the two working strands of the two endless belts are, with respect to their longitudinal extension, conically directed to each other at the feed site in such a manner that the fiber web (the initial fiber web, the pile) arranged on the working strand of the first endless belt is increasingly compacted between the advancing endless belts,
- the two endless belts are pressed, by two rollers, against the needling drum for wrapping them more strongly around the drum,
- between said two rollers, a nozzle bar is facing toward the fiber web for wetting the fiber web.

The apparatus of the above type has the advantage that the initial fiber web, i.e. the fiber web advancing voluminously, will be compacted between the two endless belts in a slowly increasing manner and with uniform pressure from above and below, while not being subjected to shearing stress, and will be wetted at the needling drum only when being tightly held between the two endless belts.

This known apparatus is distinguished particularly by an intensive wetting generated directly on the drum. Further, after the second endless belt has been led away, there can be directly performed, on the drum, a needling process with the aid of a second nozzle bar which now is oriented directly towards the fiber web arranged on the drum. This arrangement, however, is very complex and too expensive for some products.

Known from EP 1 126 064 B1 is a device wherein the compacting and the first netting of the nonwoven are simplified. This known device provides a belt-to-belt compacting and comprises the following features and respectively is designed as indicated hereunder:

- a first endless belt supporting the fiber web, said belt being guided and trained in a tensioned state between two rollers,
- a second endless belt, also guided in a tensioned state between at least two rollers, wherein the working strand of said second endless belt which is opposite to the working strand of the first endless belt is arranged to revolve in a driven manner in the same direction as that of the first endless belt,
- the two working strands of the two endless belts are, with respect to their longitudinal extension, conically directed to each other at the feed site in such a manner that the fiber web arranged on the working strand of the first endless belt is increasingly compacted between the advancing endless belts,
- in a region not supported by a guide roller, a first nozzle bar is arranged, which is assigned to the two endless belts revolving with each other and is provided with a suctioning function for wetting the fiber web.

The known apparatus are able to accomplish a slow compressing of the fiber web consisting of loose, not rigidly interconnected fibers, and the wetting process in the pressed state. Since the fiber web is compressed and wetted in this state, it will happen that, after the wetting and after detachment from the fiber web which is to be needled further on, single fibers still remain attached to the compressing endless belt (the compacting belt), which fibers will contaminate the belt and ultimately hinder a permanent optimal treatment of the subsequent fiber web.

To avoid the above described disadvantage, the belt-drum compacting according to WO 2004/046444 A1 provides that the nozzle bar arranged between the rollers guiding the compacting belt is oriented in such a manner that the water jets will impinge onto the fiber web only behind the compression region when seen in the transport direction of the fiber web.

Such an orientation of the nozzle bar will achieve an invariably effective wetting of the pressed fiber web wherein, however, the fiber web will be detached from the pressing endless belt by the water jets. At the same time, the compacting belt will be rinsed to be free of adhering fibers, and these fibers will be returned to the fiber strand. However, the described approach is possible only in a belt-drum compacting process.

From WO 2008/107549 A2, there is known a device for treatment of a non-woven wherein the web of fibers and filaments arranged on a revolving transport belt will be transferred onto the lower side of a second transport belt by application of water jets from below through the transport belt. The two transport belts have a distance larger than the thickness of the nonwoven web. By different speeds of the transport belts, the weight per surface unit of the nonwoven web can be influenced. However, by means of the two transport belts moving at different speeds, no compacting of the nonwoven web is effected. Compacting can be performed only by a further belt system, which causes considerable constructional expenditure.

DE 10 2005 055 939 B3 discloses a nozzle bar for generating fluid jets serving for compacting a fiber web. The nozzle strip comprises an exchangeable nozzle strip comprising the exit openings for the fluid. The exit openings can be arranged parallel to each other in a row, but also in two or more rows. The mutual distance and the diameter of the exit openings are dictated by the intended use. The fluid used can be pressurized water but, generally also overheated vapor.

It is an object of the present invention to improve an apparatus, known from EP 1 126 064 B1, which is provided for compacting a material web made of fibers and/or filaments, comprising a first revolving endless belt which carries the material web and is tensioned around guide rollers, and a second endless belt which is tensioned around guide rollers and revolves in the direction opposite to the first belt at the same speed, wherein the first and second endless belts, forming a conical compacting region in a first region in the conveying direction of the material web, run at an angle toward each other, whereby the material web located between the belts is increasingly pressed, wherein, subsequent to the first region, a first nozzle beam is disposed for a first fluid application onto the material web still located between the two endless belts, wherein the two belts in this region of the first fluid application are in each case guided to run in a tensioned manner in a straight direction.

According to the invention, it is provided, in a first embodiment, that, in the region of the first fluid application, the two belts are not guided in parallel extension relative to each other. The two belts, the transport belt carrying the material web consisting of fibers and/or filaments, as well as the compacting belt generating the pressing effect, extend at an acute angle relative away from each other when viewed in the transport direction of the web. Preferably, the guidance of the belts is adjustable in correspondence to the type of fibers or filaments or other conditions. Thus, it can be provided that the fluid application is performed in a region in which the web is hardly held in a pressed state anymore. Particularly, it is possible that the first fluid application is performed by means of two serially arranged, mutually parallel rows of exit openings for the fluid. It can be provided in this arrangement that, in the nozzle bar, a nozzle strip comprising the openings has two rows of exit openings, or that two nozzle bars are arranged behind each other. The latter arrangement makes it possible to perform the fluid application with different pressure values.

In an arrangement for first fluid application onto the material web arranged in a pressed state between the transport and compacting belts, which is performed by two nozzle bars, it can be provided that the two belts are guided in such a manner that the material web is still held in a pressed state during the application by the fluid jets of the first nozzle bar, but is hardly or not at all pressed anymore during the application of the fluid jets of the second nozzle bar. In case of a slight pressing process by the compacting belt or a pressing process not performed anymore, the fibers adhering in the screen tissue of the compacting belt will be driven back into the material web by the fluid jets of the second nozzle bar and, from there, be integrated into the composite structure.

The same inventive idea is realized in a second embodiment which provides the following: In the region of the first fluid application, the two belts are guided parallel to each other in a first section and are guided non-parallel to each other in a subsequent second section. A first fluid application is to be understood herein as the treatment of the fiber web by fluid jets of a single nozzle bar or a plurality of nozzle bars arranged closely behind each other.

By way of modification of the above, the following is provided:

- In a second section, the two belts are tensioned such that they extend away from each other at an acute angle.
- The two belts are together wrapped around a guide roller and extend in parallel to each other, while holding the material web in a pressed state, toward a further common guide roller.
- The non-parallel guidance of the two belts is adjustable in the second section.
- One guide roller of one of the belts is settable so that the angle of the directions in which the belts run apart from each other can be changed.
- The first fluid application is performed by means of a plurality of nozzle bars arranged closely behind each other with respect to the total path of the material web within the entire system, said nozzle bars being arranged in the first and/or the second section.
- In the first section, a first nozzle bar is arranged, and in the second section, a second nozzle bar is arranged.

According to this alternative embodiment of the invention, it is provided that the two belts in the second section are tensioned to extend away from each other at an acute angle. In the first section, the two belts are guided parallel to each other, which can be performed in that the two belts are together deflected by a first guide roller and, subsequently, by means of a further guide roller, the compacting belt is guided away from the web-carrying transport belt at an acute angle. In this section, the compacting belt will run in the direction of a further guide roller which preferably is adjustably supported to allow for adjustment of the angle at which the transport and compacting bands extend away from each other.

Further, it can be provided that, for forming the first section, the two belts which are respectively guided around two guide rollers, extend parallel to each other in the thus formed section.

In this arrangement, said common wrap-around movement around the two guide rollers can be performed in the same direction or alternately. Also in these arrangements, it is provided that, starting from the second guide roller, the compacting belt is guided at an acute angle away from the transport belt carrying the web. In this second section, the compacting band runs in the direction of a second guide roller which preferably is adjustably supported to allow for adjustment of the angle at which the transport and compacting bands extend away from each other.

According to one embodiment of the invention, a respective nozzle bar is arranged in the first and in the second section alike. Thus, in this first section, there is performed a first application, a wetting, of the fiber web held in a pressed state between the two parallel belts. In the second section, a further nozzle bar is arranged so that the wetted nonwoven will now be once more treated and compacted through the structure of the compacting belt wherein, in this second section, the compacting belt extends away from the nonwoven-carrying transport belt at an acute angle.

In case of a slight or ceased pressing performed by the compacting belt in the second section, fibers adhering in the screen tissue of the compacting belt will be driven back into the material web by the fluid jets of the second nozzle bar and, from there, be integrated into the composite structure.

In this arrangement, it can be provided that the fluid application in the two successive sections is performed with different pressure values and also different hole spacings and hole diameters.

Exemplary embodiments of the invention will be explained hereunder with reference to the drawings. In this context, the term "fiber web" is to designate a non-compacted pile of fibers and/or filaments which is delivered by a pile producer in non-compacted form (material web prior to first compacting, fluid application). The term "nonwoven" is used for the material web after the latter has undergone a first compacting.

DETAILED DESCRIPTION

Figure 1:
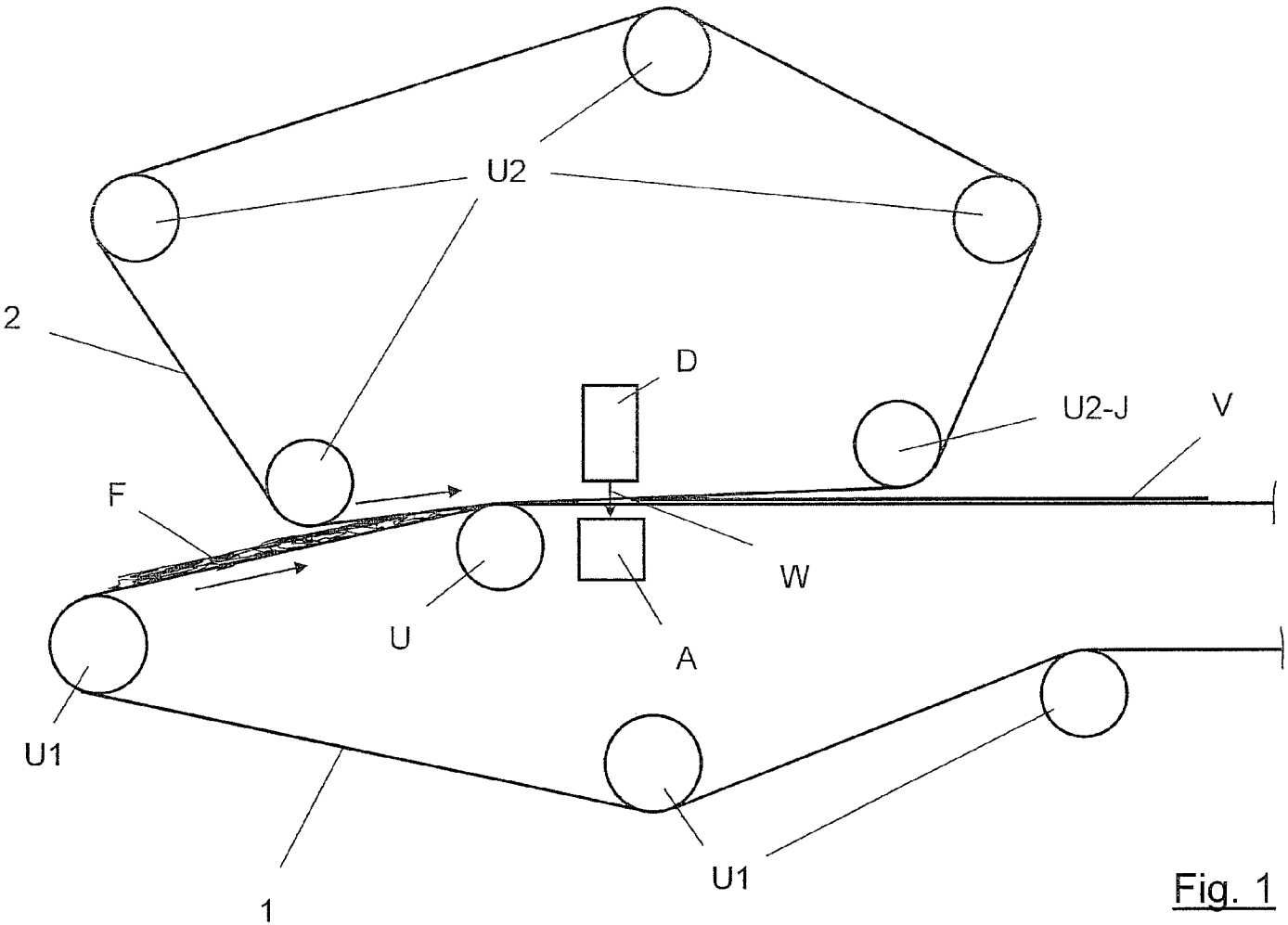
FIG. 1 illustrates an apparatus for compacting a fiber web according to an exemplary embodiment.

A transport belt 1 formed as an endless screen belt (first endless belt) is held in a tensioned state around guide rollers U,U1 and will rotate in clockwise sense as indicated by the arrow (FIG. 1). A further—compacting—belt 2 formed as an endless screen belt (second belt) is held in a tensioned state around guide rollers U2,U2-J and will rotate in anticlockwise sense as indicated by the arrow. Said compacting belt 2 runs at the same speed as said transport belt 1 and thus, in the region of its working strand, in synchronism with the working strand of transport belt 1 carrying the fiber web F. Said guide rollers U,U1,U2,U2-J are arranged for rotation in machine frame portions, not shown.

On transport belt 1, there is supplied a non-compacted fiber web F (pile) e.g. from a carding machine, not shown, and will run on the transport belt in the direction of guide roller U. By the guide roller U1 shown on the lefthand side in FIG. 1, the guide roller U and a guide roller U2, the transport belt 1 and the compacting belt 2 form a conically converging compacting region for the fiber web F. Since both the transport belt 1 and the compacting belt 2 are deflected around guide roller U, the fiber web F will be subjected to the strongest pressing force in this common wrap-around region.

Following guide roller U, transport belt 1 and compacting belt 2 will extend away from each other at an acute angle while tensioned in straight directions. The compacting belt 2 runs in the direction of guide roller U2-J, and the transport belt 1 runs in the direction of a further guide roller, not shown in FIG. 1.

In this region, following guide roller U, a first nozzle bar D is arranged above the fiber web covered by compacting belt 2. Said nozzle bar cooperates with a suction device A arranged below the transport belt 1 carrying the fiber web and, by the fluid jets W directed onto the fiber web, will effect a first slight compacting of the structure. When water jets are discharged by the nozzle bar D, the fiber web F will be wetted in this region. The fiber web F has now been compacted into a slightly consolidated nonwoven (initial nonwoven) V and will leave the region of compacting belt 2 at a site below guide roller U2-J. There follow further devices, not shown, for fluid application, further compacting and/or structuring of the nonwoven.

Figure 2:
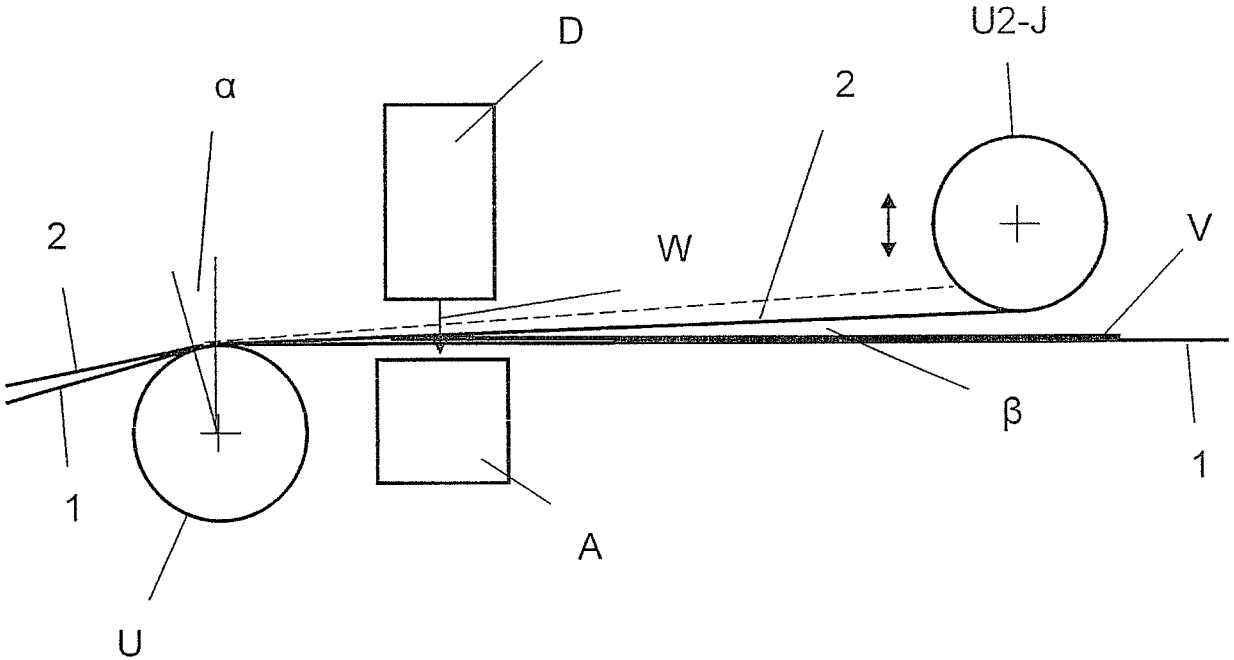
FIG. 2 illustrates an enlarged view of a transport belt.

FIG. 2 is an enlarged view of the region between the common guide roller U and the guide roller U2-J cooperating with compacting belt 2. The transport belt 1 and the compacting belt 2 cooperating therewith are wrapped around the common guide roller U at an angle $\alpha$. In this region, the fiber web is subjected to the strongest pressing effect. After guide roller U, the transport belt 1 and the compacting belt 2 extend away from each other at an acute angle $\beta$. The guide roller U2-J directing the compacting belt K away from the direction of transport belt 1 is arranged in the machine frame, not shown, in a height-adjustable manner (dual arrow) so that the angle $\beta$ can be adjusted within a range marked by the interrupted line.

Figure 3:
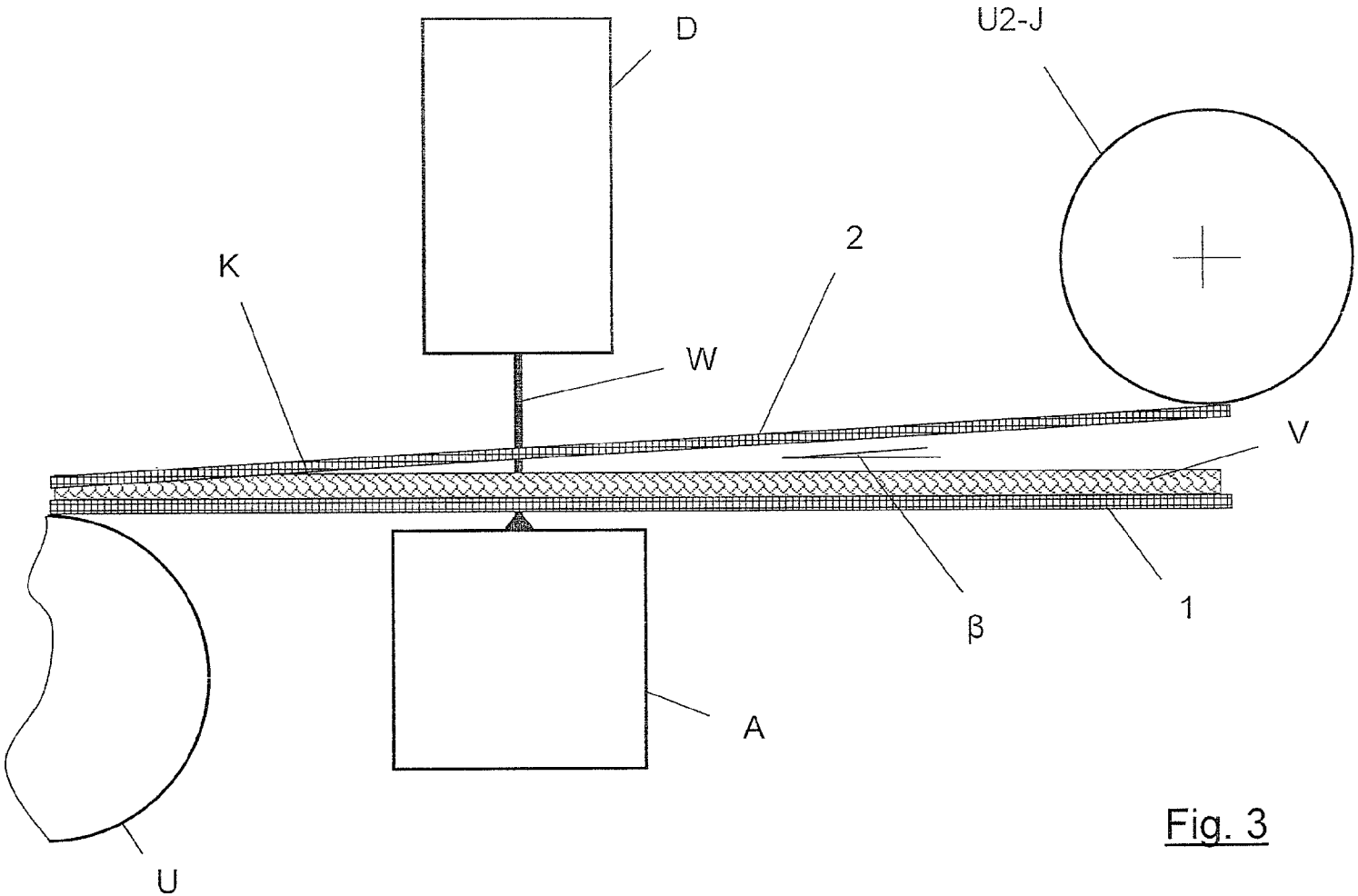
FIG. 3 illustrates a further enlarged view of the transport belt.

FIG. 3 is a further enlarged view of the arrangement according to FIG. 2 in the region between the guide roller U and the height-adjustable guide roller U2-J. The angle $\beta$ set by adjusting the guide roller U2-J, which angle is included between the transport belt 1, carrying the nonwoven V, and the compacting belt 2, is such that the fluid jets W passing through the compacting belt 2 will impinge onto the surface of the nonwoven V only after the compacting belt 2 is not in contact with the nonwoven V anymore. The final point of the contact between the compacting belt 2 and the nonwoven V is marked by K.

Figure 4:
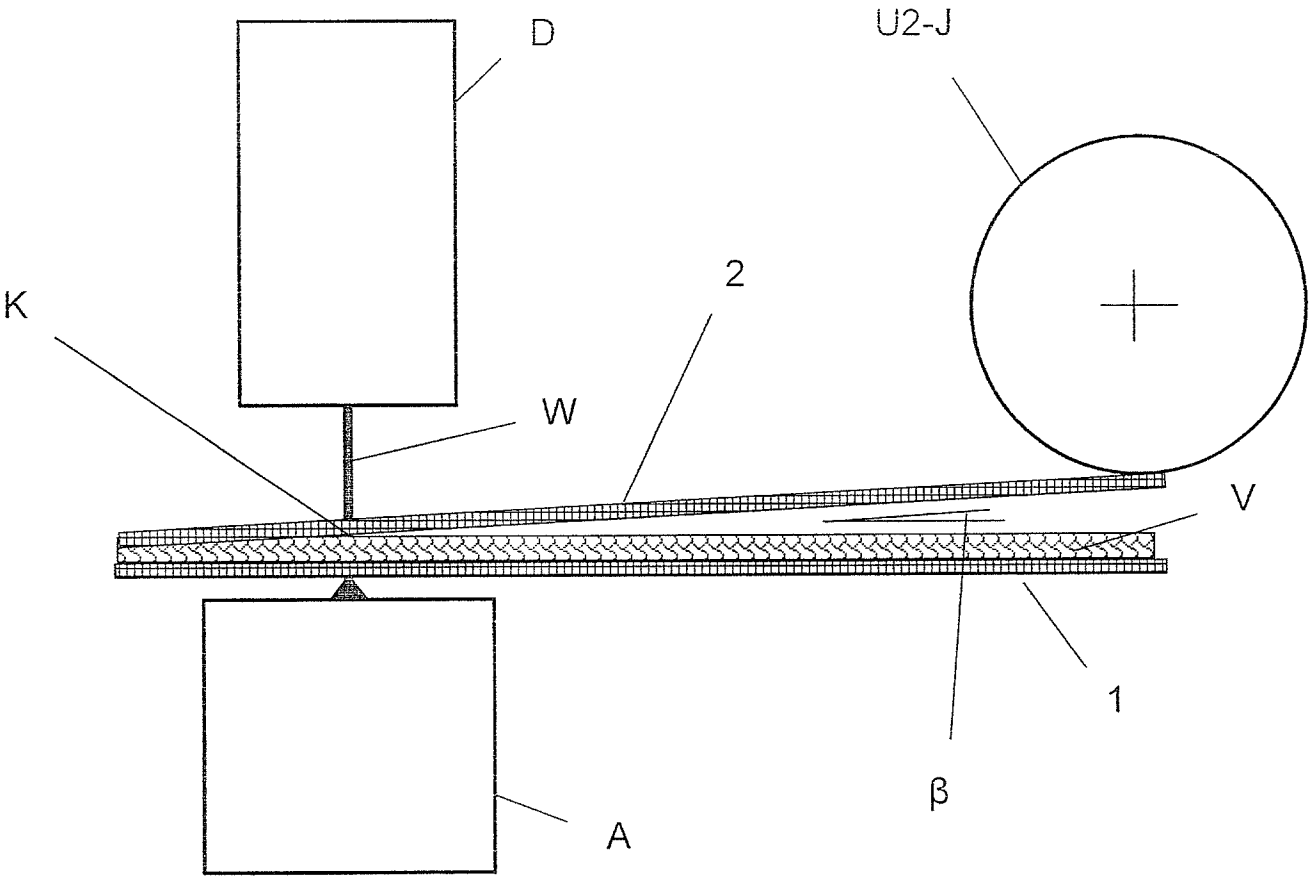
FIG. 4 illustrates an angle adjustment between the transport belt and a compacting belt.

FIG. 4 shows a situation in which the angle $\beta$ between the transport belt 1 carrying the nonwoven V and the compacting belt 2 is adjusted such that the fluid jets W passing through the compacting belt 2 will impinge onto the surface of the nonwoven V at the site K, i.e. at that site where the compacting belt 2 loses its contact with nonwoven V. The guide roller U is not shown in FIG. 4.

Thus, by adjustment of guide roller U2-J, it is possible to set the angle $\beta$ between the transport belt 1 carrying the nonwoven V and the compacting belt 2, i.e. the path between the point K from which the compacting belt 2 is not in contact with the nonwoven V anymore, and the passage of the fluid jets W through the compacting belt 2.

Further, it is also possible to set an angle $\beta$ such that the fluid jets W passing through the compacting belt 2 will impinge onto the nonwoven V when the compacting belt 2 is still in contact with nonwoven V. Also in this case, the transport belt 1 and the compacting belt 2 do not extend parallel to each other; the angle $\beta$ is only flatter than in the situations according to FIG. 3 or 4.

Figure 5:
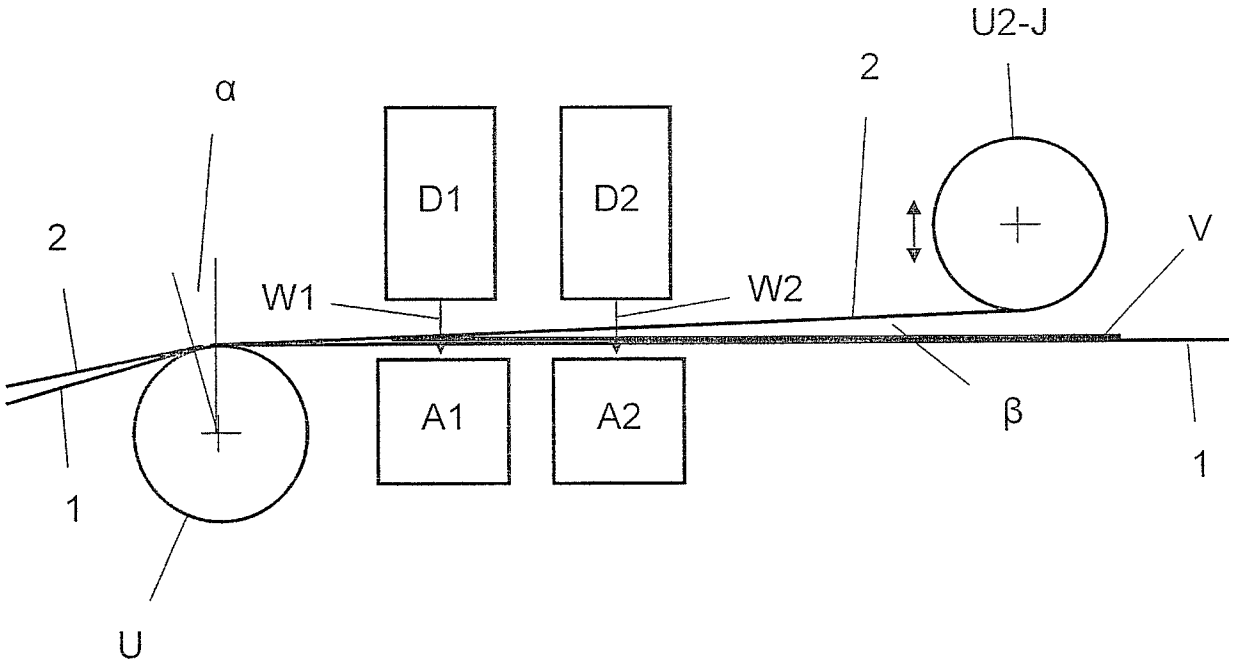
FIG. 5 illustrates the apparatus for compacting a fiber web according to another exemplary embodiment.

In the embodiment according to FIG. 5, it is provided that, in the region between the common guide roller U and the adjustable guide roller U2-J, two nozzle bars D1,D2 are arranged above compacting belt 2, with suction devices A1,A2 being arranged below transport belt 1. By means of the fluid jets W1 of the first nozzle bar D1, the nonwoven is first treated, wetted, and by means of the fluid jets W2 of the second nozzle bar D2, passing through the compacting belt 2 after the compacting belt 2 has no contact to the nonwoven V anymore, adhering fibers will be detached out of from the compacting belt 2 and returned to the nonwoven V.

Figure 6:
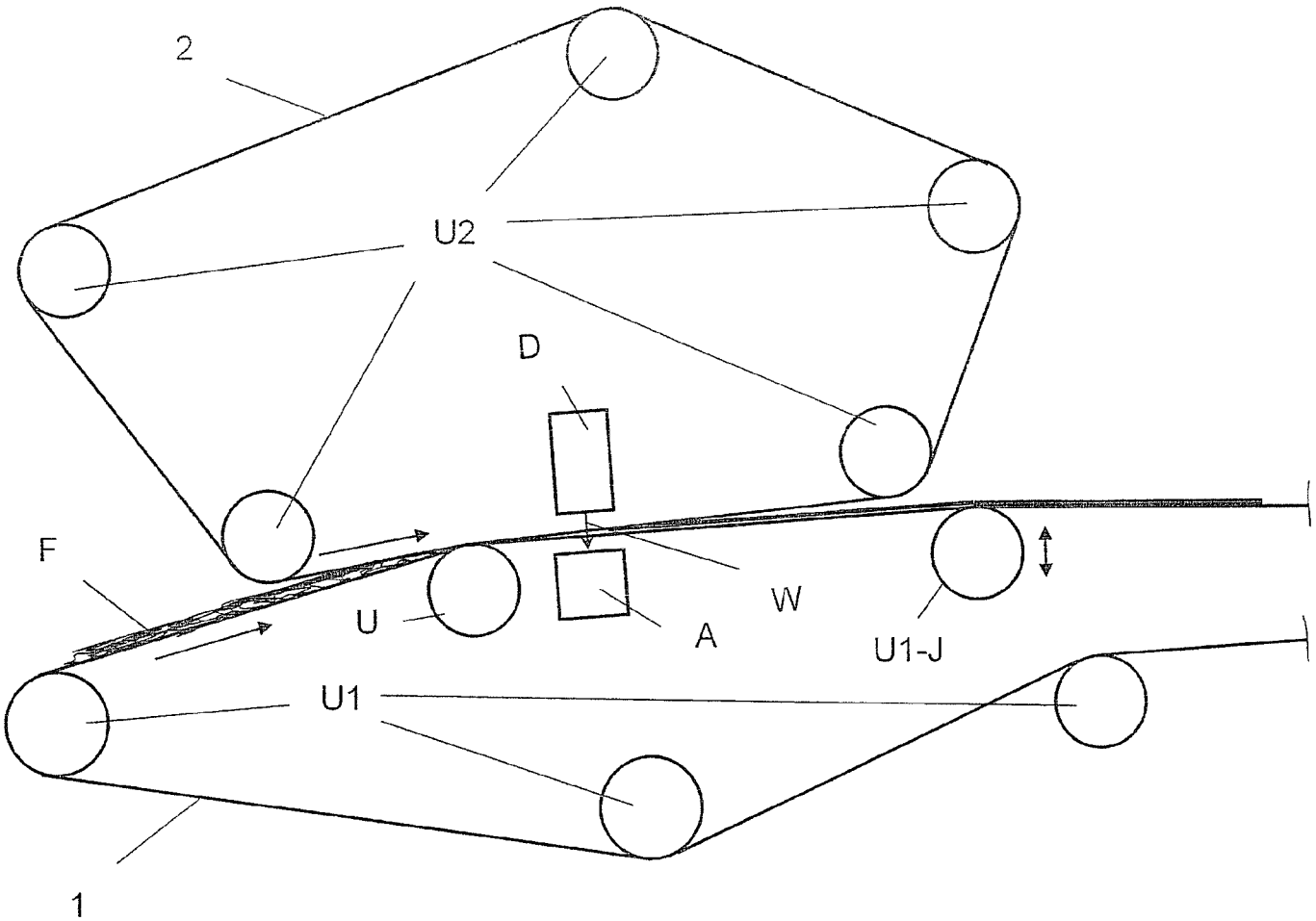
FIG. 6 illustrates the apparatus for compacting a fiber web according to another exemplary embodiment.

FIG. 6 shows an embodiment of the invention wherein, in contrast to the version shown in FIG. 1, none of the guide rollers U2 deflecting the compacting belt 2 is adjustable. The adjustment of an angle between the compacting belt 2 and the transport belt 1 carrying the nonwoven, in the region of the first application of fluid jets W, is performed by a guide roller U1-J supporting the transport belt 1, which guide roller is adjustable in the direction marked by the double arrow.

Said alternative embodiment of the invention and the corresponding variants will now be explained with reference to FIGS. 7-11.

Figure 7:
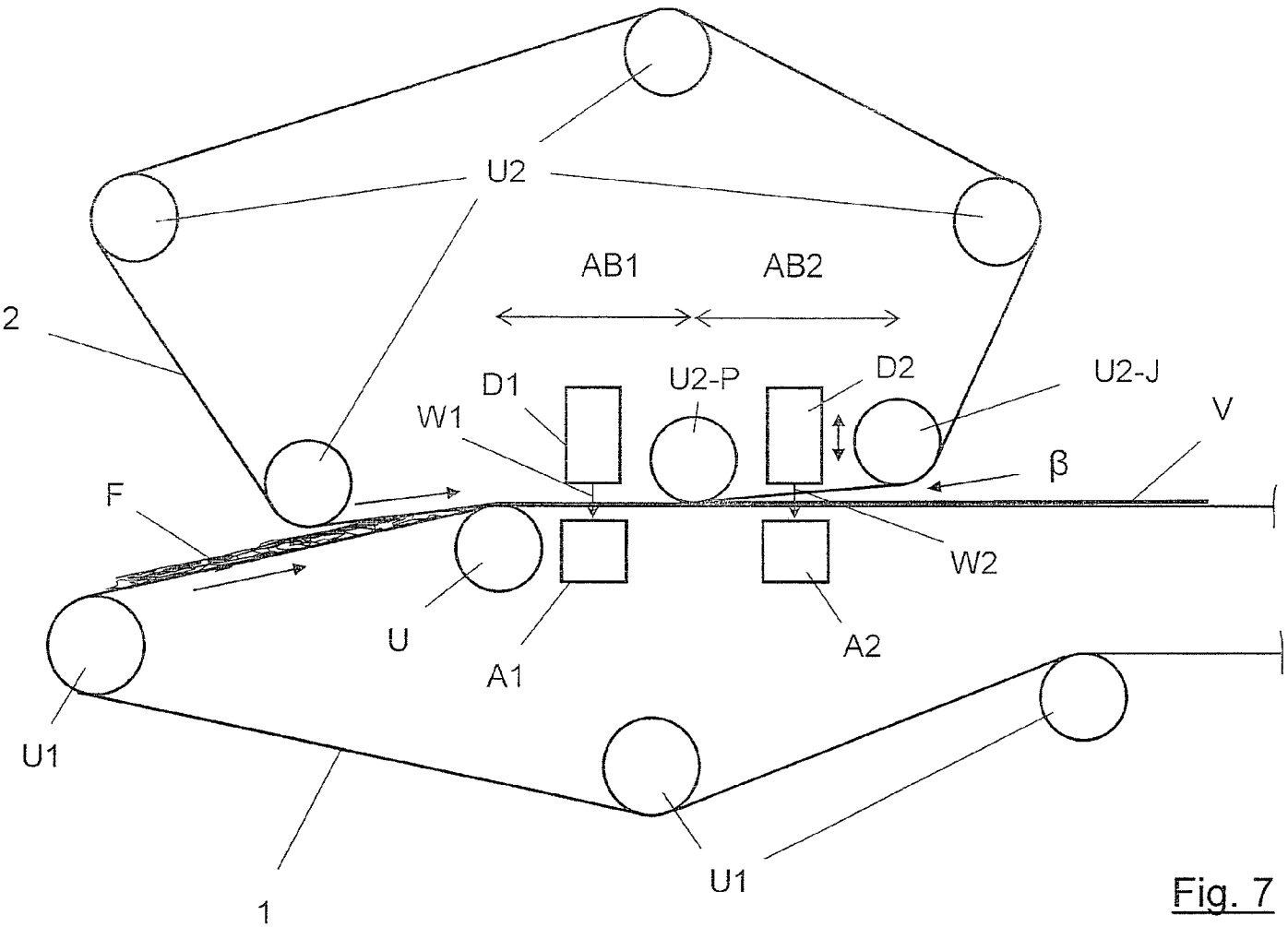
FIG. 7 illustrates the apparatus for compacting a fiber web according to another exemplary embodiment.

A transport belt 1 formed as an endless screen belt (first endless belt) is held in a tensioned state around guide rollers U,U1 and will rotate in clockwise sense as indicated by the arrow (FIG. 7). A further—compacting—belt 2 formed as an endless screen belt (second belt) is held in a tensioned state around guide rollers U2,U2P,U2-J and will rotate in anticlockwise sense as indicated by the arrow. Said compacting belt 2 runs at the same speed as said transport belt 1 and thus, in the region of its working strand, in synchronism with the working strand of transport belt 1 carrying the fiber web F. Said guide rollers U,U1,U2,U2-P,U2-J are arranged for rotation in machine frame portions, not shown.

On transport belt 1, there is supplied a non-compacted fiber web F (pile) e.g. from a carding machine, not shown, and will run on the transport belt in the direction of guide roller U. By the guide roller U1 shown on the lefthand side in FIG. 1, the guide roller U and a guide roller U2, the transport belt 1 and the compacting belt 2 form a conically converging compacting region for the fiber web F. Since both the transport belt 1 and the compacting belt 2 are deflected around guide roller U, the fiber web F will be pressed in this common wrap-around region.

In a first section AB1, the transport belt 1 and the compacting belt 2 run parallel while holding the nonwoven between them in a pressed state.

After guide roller U2-P, in second section AB2, the transport belt 1 and the compacting belt 2 extend away from each other at an acute angle β while tensioned in straight directions. The compacting belt 2 runs in the direction of the adjustable guide roller U2-J, and the transport belt 1 runs in the direction of a further guide roller. The adjustability of guide roller U2-J is visualized by the double arrow.

In said first section AB1, after guide roller U, a first nozzle bar D1 is arranged above the fiber web covered by compacting belt 2. Said nozzle bar cooperates with a suction device A1 arranged below the transport belt 1 carrying the fiber web and, by the fluid jets W1 directed onto the fiber web, will effect a slight compacting of the structure. When water jets are discharged by the nozzle bar D1, the fiber web will be wetted in this region. The fiber web F has now been compacted into a slightly consolidated non-woven (initial nonwoven) V and, past guide roller UP-P, will reach the second section AB2 in which the transport belt 1 and the compacting belt 2 extend away from each other at an acute angle β while being tensioned in a linear direction. In the second section AB2, a second nozzle bar D2 is arranged above the compacting belt 2. Below the transport belt 1 carrying the nonwoven V, a suction device 2 is arranged. Herein, the treatment of the nonwoven V is performed by the fluid jets W2 which will pass through the structure (screen belt) of compacting belt 2, then will reach the surface of the nonwoven V and the will pass through the structure of the transport belt 1. The nozzle bars D1 and D2 are arranged closely behind each other with respect to the total path of the fiber web F within the entire system and together will effect a first application of fluid onto the material web as provided according to the sense of the invention.

Figure 8:
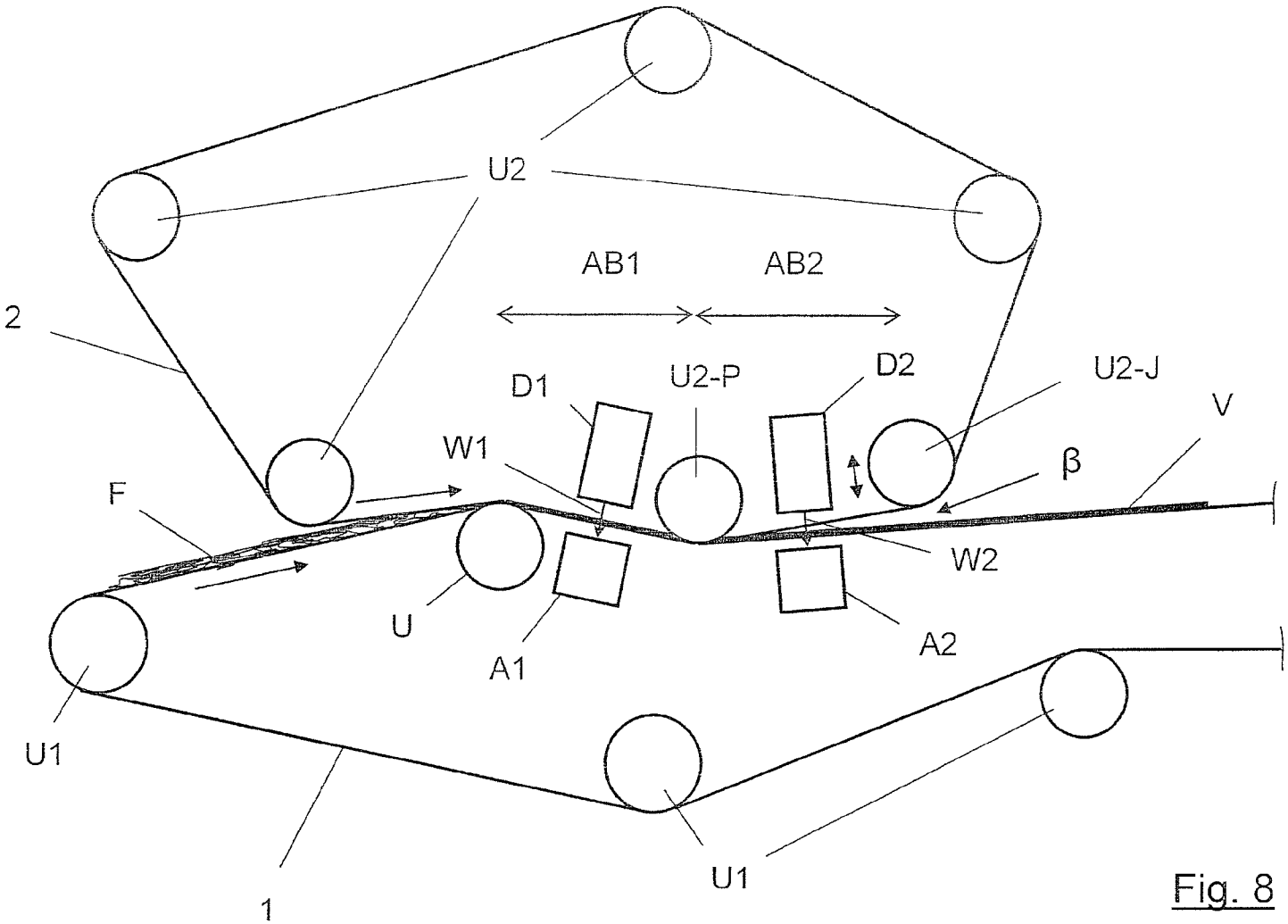
FIG. 8 illustrates the apparatus for compacting a fiber web according to another exemplary embodiment.

FIG. 8 shows an embodiment of the invention wherein the transport belt 1 and the compacting belt 2 will first run around a common guide roller U and then, redirected into the reverse direction, around a guide roller U2-P. In the first section AB1, the two belts 1,2 run parallel while holding the intermediate fiber sheet in a pressed state. This is followed by an application with fluid jets W1 of a first nozzle bar D1, with a suction device A1 arranged below the transport belt. Following the guide roller U2-P, in the second section AB2, the transport belt 1 and the compacting belt 2 extend away from each other at an acute angle β while tensioned in a linear direction. The compacting belt 2 runs in the direction of the adjustable guide roller U2-J, the transport belt 1 in the direction of a further guide roller, not shown in FIG. 2.

Figure 9:
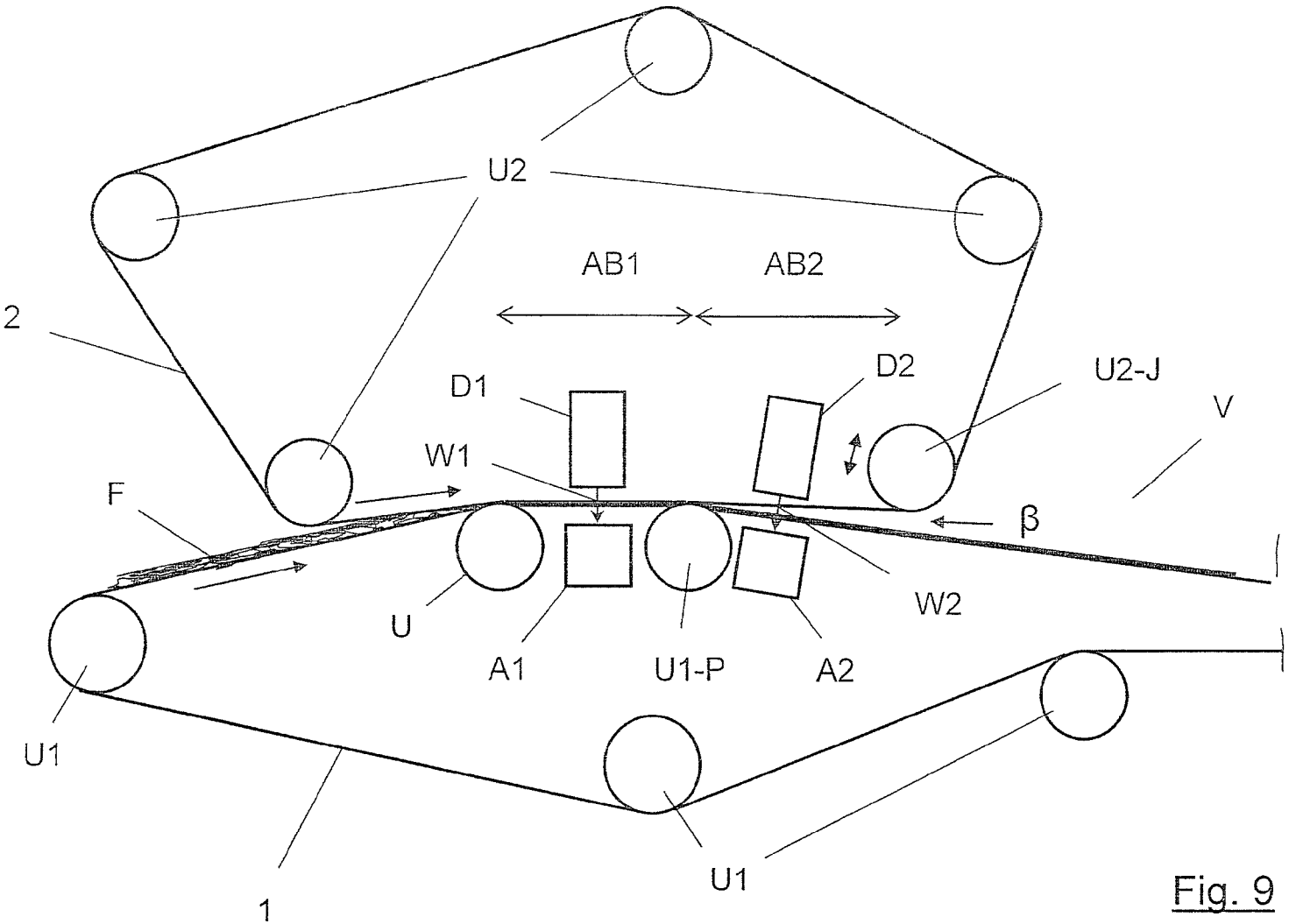
FIG. 9 illustrates the apparatus for compacting a fiber web according to another exemplary embodiment.

In the embodiment according to FIG. 9, the transport belt 1 and the compacting belt 2 each extend in the same direction while being deflected around two guide rollers U, U1-P. In this first section AB1, a first nozzle bar D1 with suction device A1 is arranged. Following the guide roller U1-P, in the second section AB2, the transport belt 1 and the compacting belt 2 extend away from each other at an acute angle β while tensioned in a linear direction. Arranged in this second section AB2 is a second nozzle bar D2 with suction device A2 for continuing the first fluid application onto the nonwoven V. Here, the treatment of the nonwoven V is performed by fluid jets W2 passing through the structure (screen belt) of the compacting belt 2, reaching the surface of nonwoven V and finally passing through the structure of transport belt 1.

Figure 10:
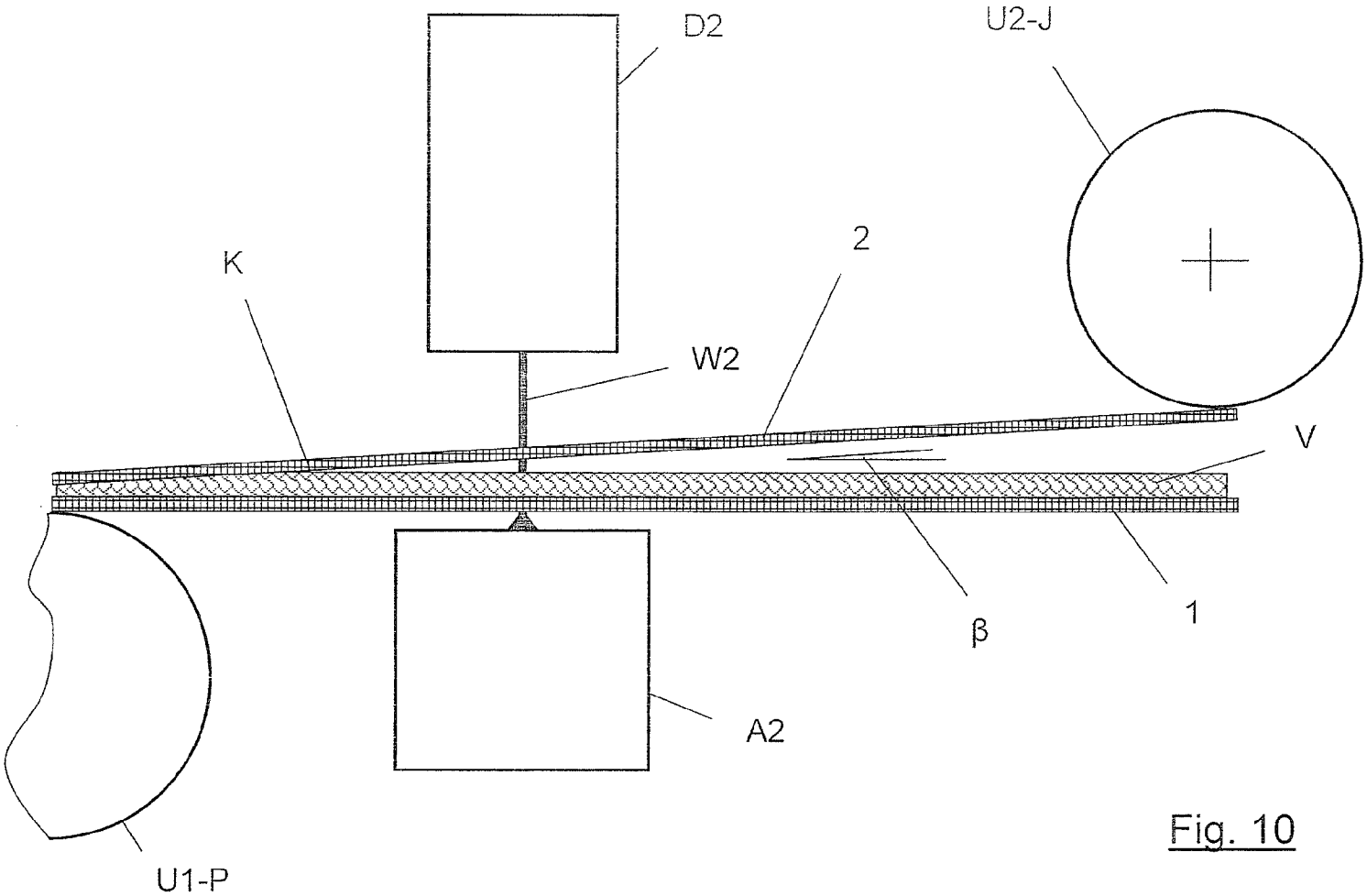
FIG. 10 illustrates an enlarged view of the apparatus for compacting a fiber web according to FIG. 9.

Thus, by adjustment of guide roller U2-J, the angle β between the transport belt 1, carrying the nonwoven V, and the compacting belt 2 can be adjusted, i.e. the distance between the point K from which the compacting belt 2 has no contact with the nonwoven V anymore, and the passage of fluid jets W2 through the compacting belt 2 (FIG. 10).

FIG. 10 is an enlarged view of the arrangement according to FIG. 9 in the second section AB2 between the guide roller U1-P and the height-adjustable guide roller U2-J. The angle β, set by the adjustability of guide roller U2-J, which angle is between the transport belt 1, carrying the nonwoven V, and the compacting belt 2, is such that the fluid jets W2 passing through the compacting belt 2 will impinge onto the surface of the nonwoven V only after the compacting belt 2 is not in contact with the nonwoven V anymore. The final point of the contact between the compacting belt 2 and the nonwoven V is marked by K.

Figure 11:
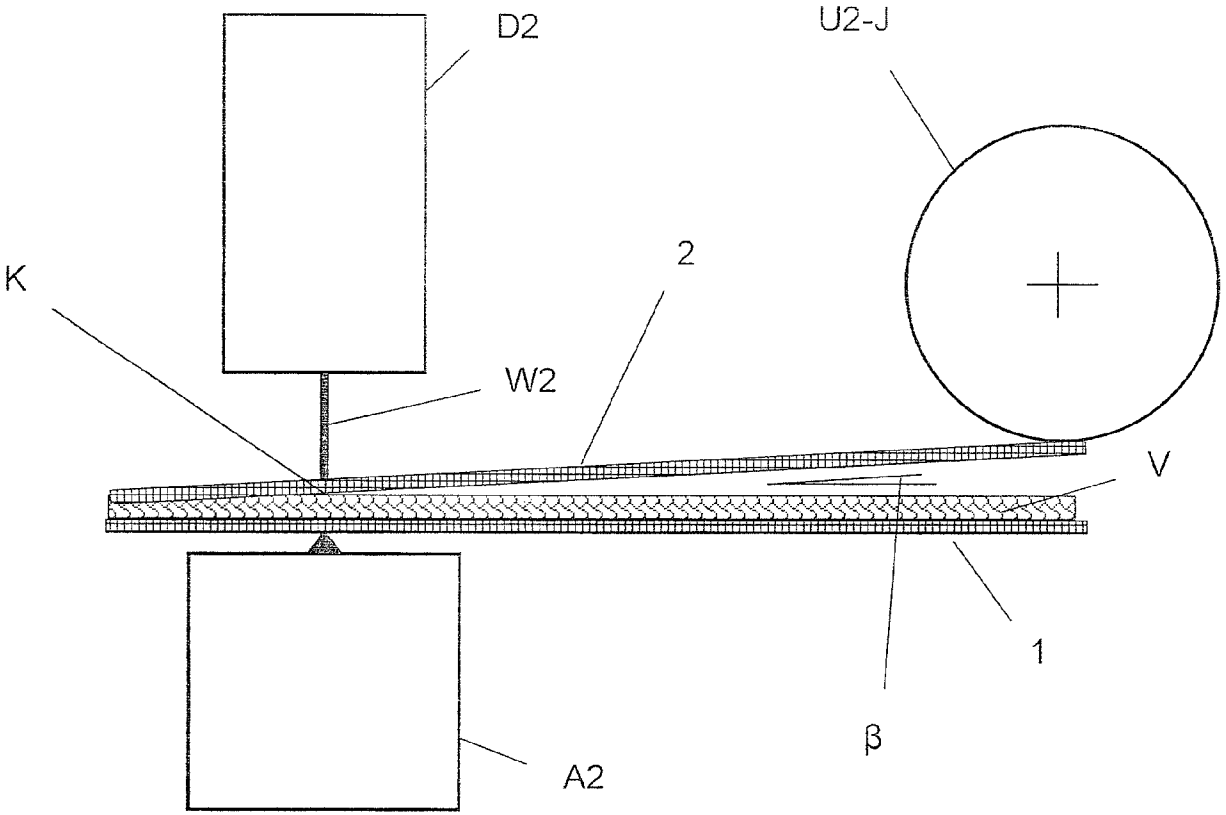
FIG. 11 illustrates the apparatus for compacting a fiber web according to another exemplary embodiment.

FIG. 11 shows a situation in which the angle β between the transport belt 1, carrying the nonwoven V, and the compacting belt 2 is adjusted such that the fluid jets W2 passing through the compacting belt 2 will impinge onto the surface of the nonwoven V at the site K, i.e. at that site where the compacting belt 2 loses its contact with nonwoven V.

Further, it is also possible to set an angle β in the second section AB2 such that the fluid jets W2 passing through the compacting belt 2 will impinge onto the nonwoven V when the compacting belt 2 is still in contact with nonwoven V. Also in this case, the transport belt 1 and the compacting belt 2 do not extend parallel to each other; the angle β is only flatter than in the situations according to FIG. 10 or 11.

LIST OF REFERENCE NUMERALS

1 transport belt, first endless belt
2 compacting belt, second endless belt
F fiber web, pile, filament web
V nonwoven, fiber web, pile, filament web after pressing, after first fluid application
U guide roller—transport belt 1, compacting belt 2
U1 guide roller—transport belt
U2 guide roller—compacting belt
U1-J guide roller—transport belt, adjustable
U2-J guide roller—compacting belt, adjustable
U1-P guide roller—transport belt
U2-P guide roller—compacting belt
D nozzle bar
D1 first nozzle bar
D2 second nozzle bar
A suction device
A1 first suction device
A2 second suction device
W fluid jet
W1 fluid jet—first nozzle bar D1
W2 fluid jet—second nozzle bar D2
AB1 first section (transport and compacting belts parallel)
AB2 second section (transport and compacting belts at an acute angle)
α wrap-around angle—transport belt 1, compacting belt 2
β angle between transport belt 1 and compacting belt 2

The invention claimed is:

1. An apparatus for compacting a material web made of fibers and/or filaments, the apparatus comprising:

a first revolving endless belt which is a transport belt and which carries the material web and is tensioned around guide rollers, and a compacting belt which is tensioned around guide rollers and revolves in the direction opposite to the first belt at the same speed, wherein the transport and compacting belts, forming a conical compacting region in a first region in the conveying direction of the material web, run at an angle toward each other, whereby the material web located between the belts is increasingly pressed, wherein, subsequent to the first region, a first nozzle beam is disposed for a first fluid application with water jets onto the material web still located between the transport and compacting belts, wherein the transport and compacting belts in this region of the first fluid application are in each case guided to run in a tensioned manner in a straight direction, wherein the transport and compacting belts are guided in the region of the first fluid application such that they do not run parallel to each other, and wherein the transport and compacting belts are tensioned in the region of the first fluid application while extending away from each other at an acute angle.

2. The apparatus according to claim 1, wherein the two belts are together wrapped around a guide roller while holding the material web in a pressed state, and then, in the region of the first fluid application, run toward a respective further guide roller.

3. The apparatus according to claim 1, wherein the non-parallel guidance of the two belts is adjustable in the region of the first fluid application.

4. The apparatus according to claim 3, wherein one guide roller of one of the belts is settable so that the acute angle of the directions in which the belts extend away from each other is variable.

5. The apparatus according to claim 1, wherein, in the region of the first fluid application, a second nozzle bar is arranged adjacent to the first nozzle bar.

6. An apparatus for compacting a material web made of fibers and/or filaments, the apparatus comprising:

a first revolving endless belt which is a transport belt and which carries the material web and is tensioned around guide rollers, and a compacting belt which is tensioned around guide rollers and revolves in the direction opposite to the first belt at the same speed, wherein the transport and compacting belts, forming a conical compacting region in a first region in the conveying direction of the material web, extend at an angle with respect to each other, whereby the material web located between the belts is increasingly pressed, wherein, subsequent to the compacting region, nozzle beams are disposed for a first fluid application with water jets onto the material web still located between the transport and compacting belts, wherein the two belts in this region of the first fluid application are in each case guided to run in a tensioned manner in a straight direction, wherein the two belts are guided in the region of the first fluid application such that they extend parallel to each other in a first section and not parallel to each other in a subsequent second section, wherein nozzle beams are disposed in the first and the second section for the first fluid application, and wherein the two belts are tensioned in the second section such that they extend away at an acute angle.

7. The apparatus according to claim 6, wherein the two belts are together wound around a guide roller and, while holding the material web pressed, extend parallel to each other to a further common guide roller.

8. The apparatus according to claim 6, wherein the non-parallel guidance of the two belts is adjustable in the second section.

9. The apparatus according to claim 8, wherein one guide roller of one of the belts is settable so that the acute angle of the directions in which the belts extend away from each other is variable.

10. The apparatus according to claim 6, wherein the first fluid application is performed by a plurality of nozzle bars that are arranged closely behind each other with respect to the total path of the material web within the entire system, said nozzle bars being arranged in the first and/or second section.

11. The apparatus according to claim 6, wherein a first nozzle bar is arranged in the first section, and a second nozzle bar is arranged in the second section.

* * * * *